US006325525B1

(12) United States Patent
Camarota

(10) Patent No.: US 6,325,525 B1
(45) Date of Patent: Dec. 4, 2001

(54) ADJUSTABLE TRACK SYSTEM FOR EXIT LIGHT

(75) Inventor: Richard J. Camarota, Holland, MI (US)

(73) Assignee: ITC, Inc., Holland, MI (US)

( * ) Notice: Subject to any disclaimer, the term of this patent is extended or adjusted under 35 U.S.C. 154(b) by 0 days.

(21) Appl. No.: 09/405,624

(22) Filed: Sep. 24, 1999

(51) Int. Cl.[7] ..... F21V 21/14
(52) U.S. Cl. ..... 362/250; 362/418
(58) Field of Search ..... 362/382, 419, 362/812, 250, 457, 458, 249, 251, 239, 240, 371, 370; 40/570

(56) References Cited

U.S. PATENT DOCUMENTS

| | | | | |
|---|---|---|---|---|
| 1,964,471 | * | 6/1934 | Klingberg | 439/682 |
| 4,999,755 | * | 3/1991 | Lin | 362/250 |
| 5,410,453 | * | 4/1995 | Ruskouski | 326/20 |
| 5,607,227 | * | 3/1997 | Yasumoto | 362/245 |
| 5,954,423 | * | 9/1999 | Logan | 362/235 |

* cited by examiner

*Primary Examiner*—Alan Cariaso
*Assistant Examiner*—Hargobind S. Sawhney

(74) *Attorney, Agent, or Firm*—Raphael A. Monsanto; Benita J. Rohm; Richard A. Gaffin

(57) ABSTRACT

An arrangement for variably mounting an illumination device in an enclosure, such as a safety sign, is provided with a longitudinal track having a longitudinal engagement portion. One or more illumination devices are provided with associated mounting feet for engaging slidably with the longitudinal engagement portion of the track. The track then is fixed onto a pair of stanchions having a respective plurality of engaging portions so that any of several heights can be achieved with respect to a base portion of the stanchion. Engagement of the mounting feet and the longitudinal track is effected by a longitudinal bent portion of the track that defines a space therewithin that accommodates the mounting feet. In addition, the longitudinal track accommodates the engagement portions of the stanchion for supporting the longitudinal track at the desired height. In this manner, the positions of the illumination devices can be adjusted along two dimensions whereby the luminance of the illumination devices can be positioned in desired relation to the printing on a translucent panel of a fixture that bears a printed message, as would be the case with an exit sign. An electrical coupling arrangement permits the illumination device to be coupled electrically to pre-existing enclosures. This enables existing antiquated safety illumination systems to be fitted easily with modern internal components that comply with applicable codes and standards.

27 Claims, 5 Drawing Sheets

ADJUSTABLE TRACK SYSTEM FOR EXIT LIGHT

BACKGROUND OF THE INVENTION

1. Field of the Invention

This invention relates generally to illumination systems, and more particularly, to a retrofit system wherein existing illuminated signs, such as "exit signs" can be adapted to accommodate more modern sources of illumination.

2. Description of the Related Art

There are in existence many thousands of safety lighting systems that are intended to supply illumination automatically to critical areas and equipment in the event of failure of the normal power supply. Many safety lighting arrangements in use today are antiquated and need to be updated to current standards. In particular, existing remote lamp assemblies, exit fixtures, and safety lights, including self-luminous exit signs, are generally of a type that the illumination of which is essential to human life during certain conditions. It is, therefore, of critical importance that such systems function in compliance with modern standards.

It is a problem with some of the current safety lighting fixtures that they internally are out of compliance with current standards, but the exterior of the fixture is architecturally incorporated into its environment and cannot readily be replaced. Accordingly, there is a need for a retrofit system whereby the existing internal components of the illumination arrangement are removed and replaced with acceptable components. Since, as stated, existing safety lighting arrangements are available in a multiplicity of designs and sizes, there is a need that the retrofit system that would modernize such a safety lighting arrangement be configurable dimensionally.

3. Objects of the Invention

It is, therefore, an object of this invention to provide a retrofit system for replacing the internal components of a safety illumination arrangement.

It is another object of this invention to provide a safety lighting arrangement retrofit system wherein one or more illumination elements can be disposed at predetermined variable locations that are determined in response to a printed message on the safety illumination arrangement, such as an exit sign.

It is also an object of this invention to provide a simple an inexpensive system for upgrading existing safety illumination arrangements.

SUMMARY OF THE INVENTION

The foregoing and other objects are achieved by this invention which provides an arrangement for variably mounting an illumination device in an enclosure. In accordance with the invention, there is provided a longitudinal track having a longitudinal engagement portion. A mounting foot that is coupled to the illumination device engages slidably with the longitudinal engagement portion of the longitudinal track, and therefore is translatable therealong. A fixation arrangement fixes the longitudinal track within the enclosure at any one of a plurality of available heights. Thus, the illumination device can be positioned in a range of positions within the enclosure. In accordance with one embodiment of the invention, the longitudinal engagement portion of the longitudinal track includes a longitudinal bent portion to define a longitudinal space wherein the mounting foot is accommodated. As stated, the mounting foot of the illumination device is coupled thereto and is longitudinally displaceable along the longitudinal track. Preferably, a further longitudinal bent portion of the longitudinal track is arranged parallel to the first longitudinal bent portion. Thus, there is defined a further longitudinal space wherein the mounting foot is accommodated. This prevents disengagement of the illumination device from the longitudinal track, except when it is displaced beyond the length of the track.

In a further embodiment, the fixation arrangement has a plurality of attachment points. This permits the longitudinal track to be fixed at a selectable one of a plurality of fixed locations within the enclosure. Thus, the track is adjustable, illustratively vertically, by selection of an appropriate one of a plurality of attachment points, and the illumination device is slidably adjustable horizontally along the track. Each of the attachment points in this embodiment is provided with a coupler portion that couples with the longitudinal track at an end thereof. The coupler portions are each fixed to a respective one of first and second stanchions that support the coupler portions in the vicinity of their respective ends of the longitudinal track.

In accordance with a further apparatus aspect of the invention, there is provided an arrangement for variably mounting an illumination device in an enclosure. The arrangement is provided with a longitudinal track that has a longitudinal engagement portion intermediate of first and second track ends. Additionally, a mounting foot is coupled to the illumination device for engaging slidably with the longitudinal engagement portion of the longitudinal track.

In one embodiment of this further aspect of the invention, there are provided first and second fixation arrangements for fixing the longitudinal track within the enclosure at respective ones of the first and second track ends. In an embodiment where the enclosure is an illuminated sign, and the fixed relation within the enclosure is determined by a predetermined spatial relationship between the illumination device and a message printed on the illuminated sign, the specific location of the illumination element can be varied in two dimensions, thereby enabling the illumination device to be arranged in a determined relation with respect to the message printed on the illuminated sign.

As previously described, the couplers that are attached to the stanchions are arranged to be accommodated longitudinally within a respective one of the track ends. Thus, no additional interconnection arrangement is required. In addition, the stanchion is provided with a base that may be provided with an adhesive to facilitate mounting within the enclosure. In other embodiments, the track itself may be provided with adhesive on the underside, for use as required.

The mounting foot that is engageable with the track has coupled thereto a lamp mounting portion that, in this embodiment, couples to a collar of the illumination device. In one embodiment, the collar of the illumination device and the mounting portion attached to the mounting foot are configured to engage with one another, thereby preventing rotation of the illumination device after installation. Of course, in some embodiments, a limited amount of rotation may be permitted, and in other embodiments, there may be no limitations on the rotational position of the illumination device installed on the lamp mounting portion of the mounting foot.

In some embodiments of the invention, a plurality of illumination devices may be provided to effect a more uniform distribution of illumination within the enclosure. In such an embodiment, the various illumination devices would each have associated therewith a mounting foot for engaging with the track. Additionally, each mounting foot would have an associated lamp mounting portion which may impose rotational limitations on the illumination device with respect thereto.

In accordance with a further aspect of the invention, there is provided a retrofit kit for an illuminated safety sign of the type having an original illumination device interposed between printed translucent panels. The original illumination device would be removed to facilitate installation of the retrofit kit. In accordance with the invention, a retrofit kit is provided with a replacement illumination device. A longitudinal track having an elongated engagement portion intermediate of first and second track ends is provided. As stated, a mounting foot couples to the replacement illumination device for engaging slidably within the longitudinal engagement portion of the longitudinal track. Additionally, a stanchion arrangement has a plurality of engagement portions that extend transversely therefrom, each of the engagement portions being configured to engage with a track end for fixing the longitudinal track within the enclosure. The engagement portion is engaged with the track end being selected in response to the location of the printed message on the printed translucent panels.

BRIEF DESCRIPTION OF THE DRAWINGS

Comprehension of the invention is facilitated by reading the following detailed description, in conjunction with the annexed drawing, in which.

DETAILED DESCRIPTION

Figure 1:
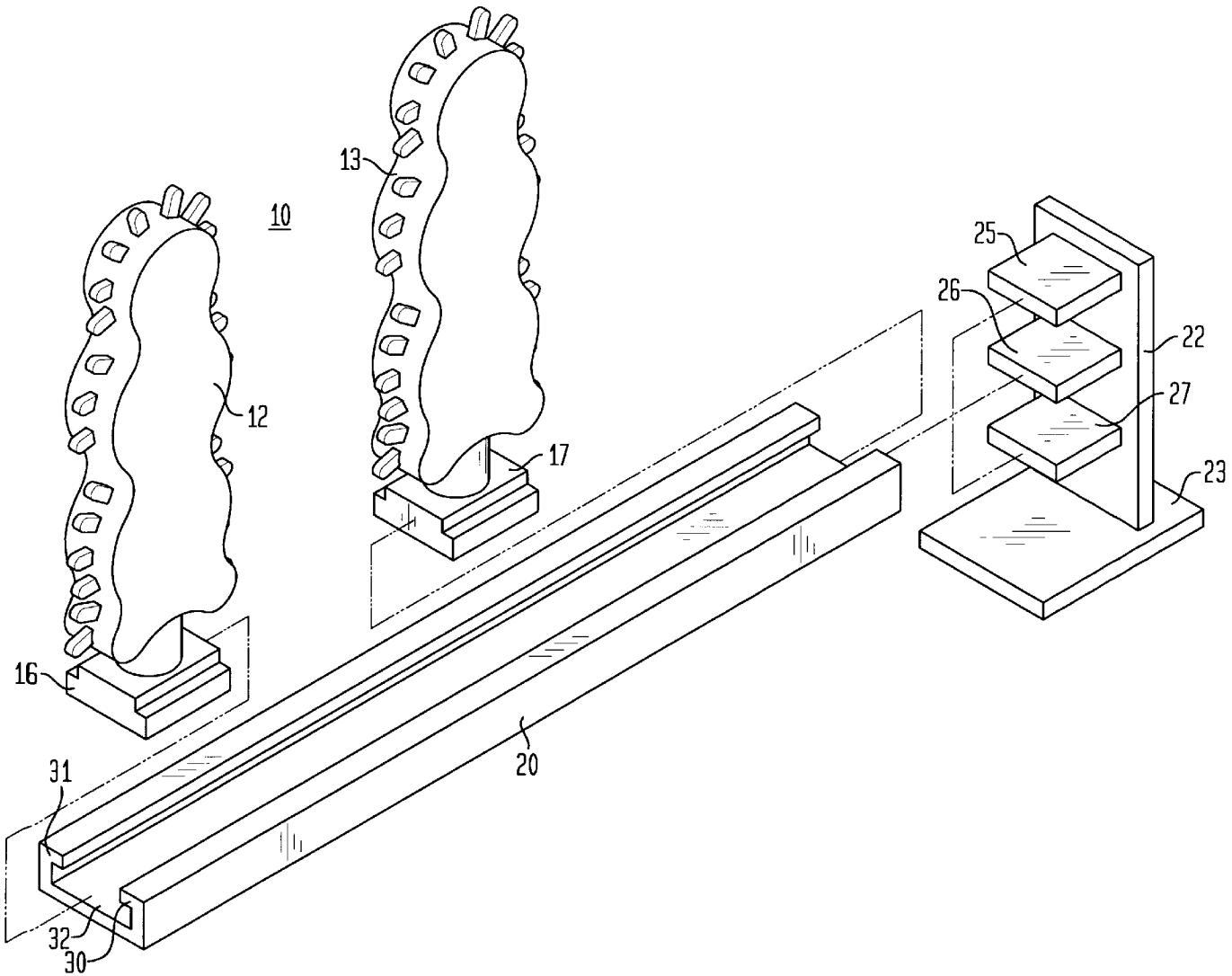
FIG. 1 is an exploded isometric representation of certain components of the invention, specifically a plurality of illumination devices, a longitudinal track, and a stanchion with plural attachment elements.

FIG. 1 is an exploded isometric representation of an illumination arrangement 10. As shown, illumination devices 12 and 13 are provided with respective mounting feet 16 and 17 that engage with a longitudinal track 20. In this specific illustrative embodiment of the invention, there is provided a stanchion 22 that functions as a fixation arrangement for the longitudinal track. More specifically, stanchion 22 has a base portion 23, and there are provided a plurality of engagement portions 25,26, and 27.

Longitudinal track 20 is shown to have longitudinally bent portions 30 and 31 that define a longitudinal space 32. Mounting feet 16 and 17 engage slidably within longitudinal space 32. In addition, the longitudinal track can engage with any of engagement portions 25,26, and 27, thereby affording a variably adjustability of the distance between longitudinal track 20 and base portion 23.

Figure 2:
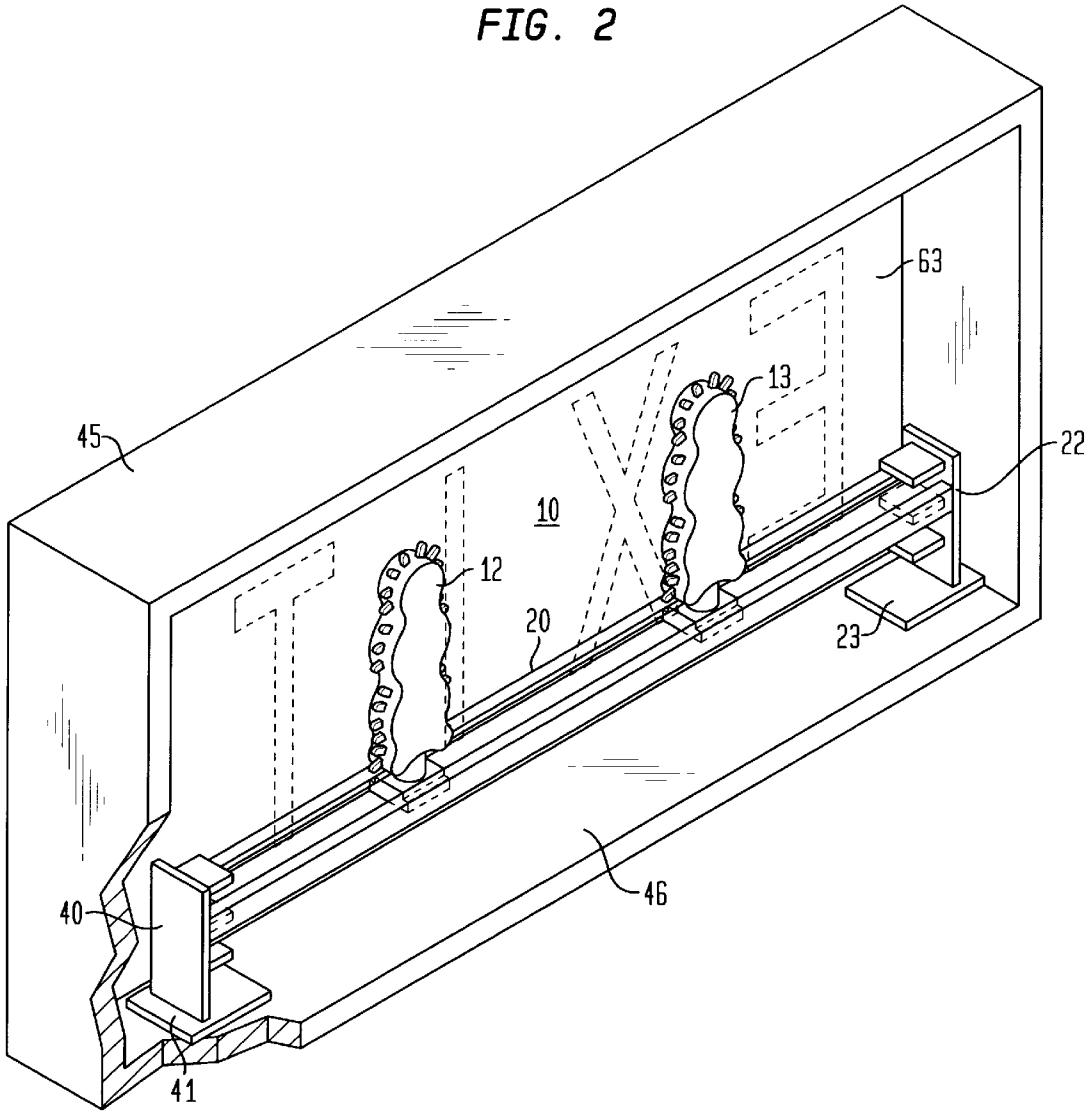
FIG. 2 is an isometric representation of an embodiment of the invention showing the illumination arrangement installed in an enclosure.

FIG. 2 is an isometric representation of illumination arrangement 10 disposed within an enclosure 45. Elements of structure that have previously been discussed are similarly designated. In FIG. 2, longitudinal track 20 is shown to be supported at one end thereof by stanchion 22 and at the other end thereof by a further stanchion 40 that is provided with a respective base portion 41. In this embodiment, base portions 23 and 41 of the respective stanchions are coupled to a bottom 46 of enclosure 45, illustratively by an adhesive (not shown).

Figure 3:
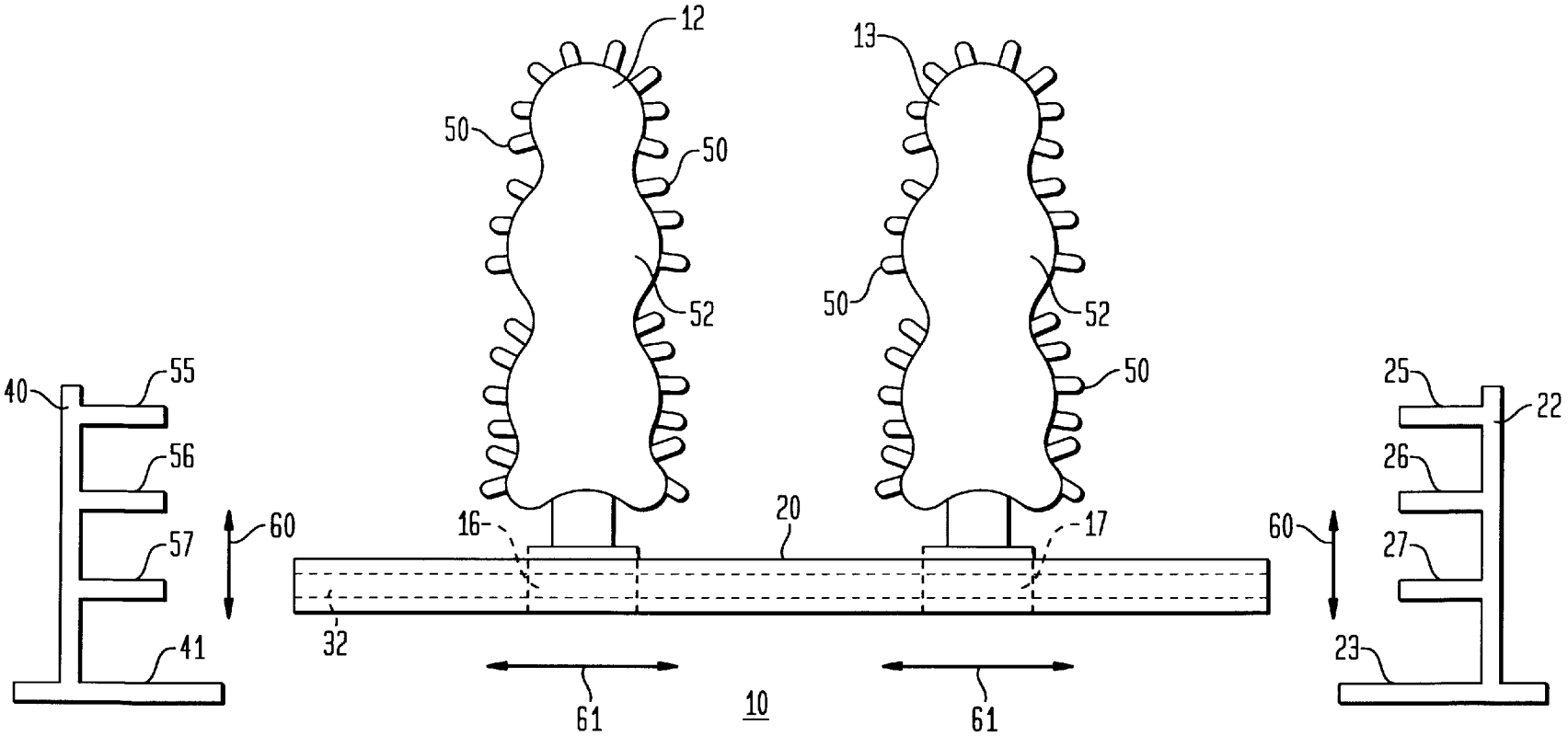
FIG. 3 is a plan representation of an embodiment of the invention showing the various degrees of adjustability of the illumination elements.

FIG. 3 is a plan representation of illumination arrangement 10 showing the various degrees of adjustability of illumination devices 12 and 13. In this specific embodiment of the invention, illumination devices 12 and 13 are commercially available lamp systems that provide a uniform illumination over a large area by reason of their being provided with a plurality of lighting elements 50 distributed about the periphery of an irregularly shaped body 52. Illumination elements 15 may comprise a distributed array of light-emitting diodes, the driving circuitry therefor (not shown) being contained with body 52. These elements are identically designated with both illumination devices 12 and 13. FIG. 3 additionally shows that longitudinal track 20 may be coupled with any of engagement portions 25, 26, and 27 of stanchion 22, as well as corresponding stanchion engagement portions 55, 56, and 47 of stanchion 40. Thus, the illumination devices are shown to be adjustable in the direction of arrows 60. Similarly, since mounting feet 16 and 17 are laterally displaceable within longitudinal space 32 of longitudinal track 20, the illumination devices are individually adjustable in the direction of arrows 61.

Referring once again to FIG. 2, the adjustability of illumination devices 12 and 13 is useful to ensure that illumination from the illumination devices is adequately distributed onto a translucent panel 63 which, in this specific illustrative embodiment of the invention, is shown to have the word "Exit" printed thereon. A similar translucent panel (not shown) maybe provided on the opposite side of translucent panel 63.

Figure 4:
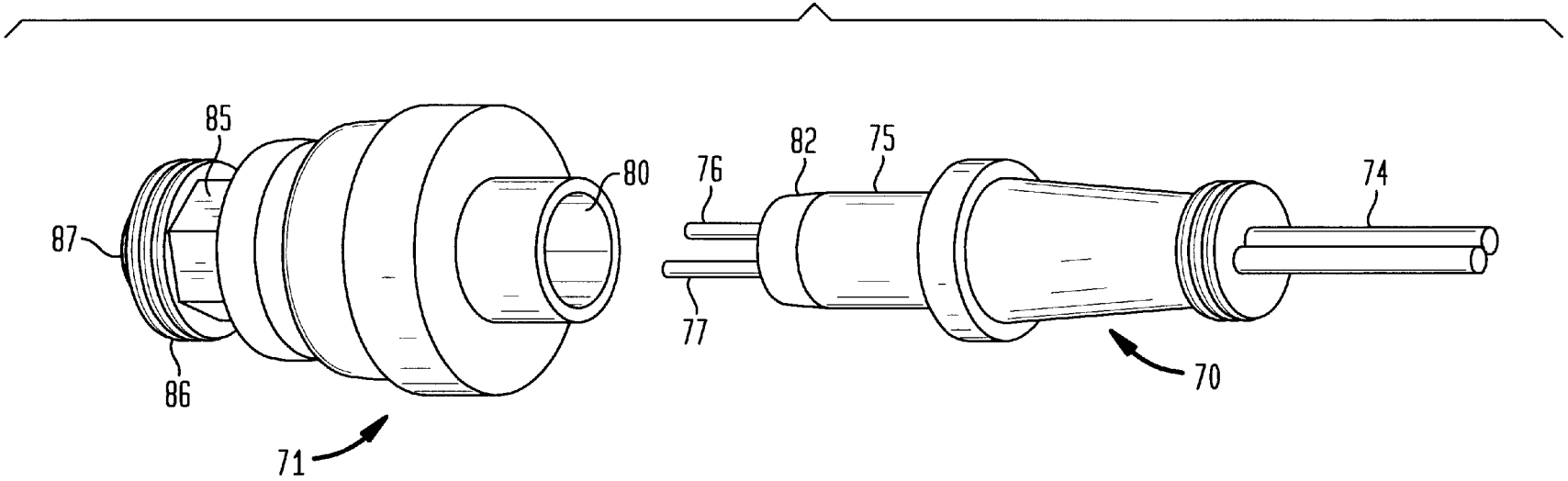
FIG. 4 is a perspective representation of a twin lead arrangement and a converter that converts the electrical connection to a screw shell arrangement.

FIG. 4 is a perspective representation of a twin lead arrangement 70 and a converter 71 that converts the electrical connection to a screw shell arrangement. As shown, twin lead arrangement 70 has a length of two-conductor electrical wiring 74 that is terminated at a plug 75 having a pair of male electrical terminals 76 and 77. The male electrical terminals are electrically coupled to respective conductors (not shown) in two-conductor electrical wiring 74. The distal end of two-conductor electrical wiring 74 (not shown in this figure) is connected to illumination devices 12 and 13.

Converter 71 is shown to have a receptacle 80 that accommodates male electrical terminals 76 and 77. In some embodiments, receptacle 80 will also accommodate a forward portion 82 of plug 75. Inside receptacle 80 there are provided a pair of female electrical terminals (not shown) that engage physically and electrically with male electrical terminals 76 and 77. The other end of converter 71 is in the form of a screw shell 85 that is provided with a threaded region 86 and a center terminal 87. The electrical terminals in the form of the screw shell and the center terminal are electrically coupled to respective ones of the pair of female electrical terminals (not shown). When twin lead arrangement 70 and converter 71 are engaged, the screw shell and the center terminal are electrically coupled to respective ones of the pair of conductors (not shown) in two-conductor electrical wiring 74.

Figure 5:
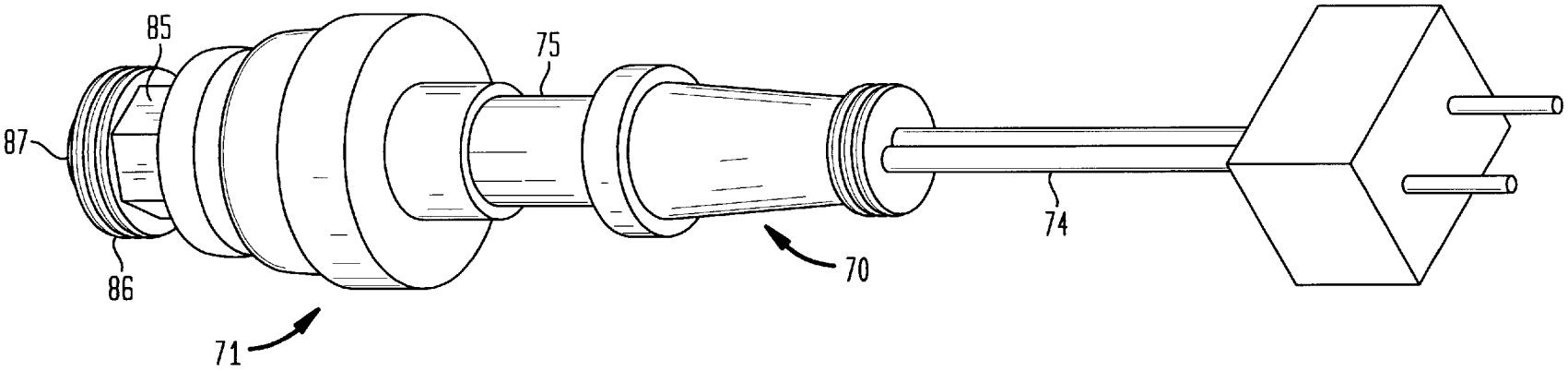
FIG. 5 is a perspective representation of the embodiment of FIG. 4 showing the twin lead arrangement engaged with the converter.

FIG. 5 is a perspective representation of the embodiment of FIG. 4 showing the twin lead arrangement engaged with the converter. Elements of structure that previously have been discussed are similarly designated. This electrical coupling arrangement enhances the ability to retrofit the system of the present invention into preexisting lighting arrangements, such as safety lighting fixtures.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. An arrangement for variably mounting an illumination device in an enclosure, the arrangement comprising:

a longitudinal track defining a longitudinal engagement space;

a mounting foot coupled to the illumination device for engaging slidably within the longitudinal engagement of said longitudinal track; and a fixation arrangement for fixing said longitudinal track within the enclosure, said fixation arrangement having a plurality of engagement portions whereby said longitudinal track is fixed at a selectable one of a plurality of fixed locations within the enclosure.

2. The arrangement of claim 1, wherein the longitudinal engagement space of said longitudinal track comprises a longitudinal bent portion of said longitudinal track arranged to define a longitudinal space wherein said mounting foot is accommodated, said mounting foot and the illumination device coupled thereto being longitudinally displaceable along said longitudinal track.

3. The arrangement of claim 2, wherein the longitudinal engagement space of said longitudinal track comprises a further longitudinal bent portion of said longitudinal track parallel to said longitudinal bent portion, the further longitudinal bent portion being arranged to define a further longitudinal space wherein said mounting foot is accommodated, whereby said mounting foot is fixed to, and longitudinally displaceable along, said longitudinal track.

4. The arrangement of claim 1, wherein the engagement portions by which said longitudinal track is fixed at a selectable one of a plurality of fixed locations within the enclosure engage within the longitudinal engagement space of said longitudinal track.

5. The arrangement of claim 4, wherein said plurality of fixed locations within the enclosure are disposed substantially orthogonal to said longitudinal track.

6. The arrangement of claim 5, wherein said longitudinal track is arranged substantially horizontal within the enclosure, and said plurality of fixed locations within the enclosure are substantially vertically related to each other.

7. The arrangement of claim 5, wherein there is further provided a respective coupler portion at each of said plurality of fixed locations for coupling with said longitudinal track at an end thereof.

8. The arrangement of claim 7, wherein there are further provided first and second stanchions for supporting said respective coupler portions in the vicinity of respective ends of said longitudinal track.

9. The arrangement of claim 1, wherein there is further provided an electrical coupler arrangement for coupling the illumination device to a source of electrical energy.

10. The arrangement of claim 9, wherein said electrical coupler arrangement is provided with a twin lead electrical connector for providing an electrical potential to the illumination device.

11. The arrangement of claim 10, wherein said electrical coupler arrangement is further provided with an electrical interconnection converter for converting a twin lead electrical interconnection arrangement into a screw shell electrical coupling arrangement.

12. An arrangement for variably mounting an illumination device in an enclosure, the arrangement comprising:

a longitudinal track having a longitudinal engagement space intermediate of first and second track ends;

a mounting foot coupled to the illumination device for engaging slidably within the longitudinal engagement space of said longitudinal track; and first and second fixation arrangements for fixing said longitudinal track within the enclosure at respective ones of said first and second track ends, each of said fixation arrangements having a respectively associated stanchion having a plurality of couplers affixed thereto for engaging with a respective one of said first and second track ends.

13. The arrangement of claim 12, wherein there are further provided first and second fixation arrangements for fixing said longitudinal track within the enclosure at respective ones of said first and second track ends.

14. The arrangement of claim 12, wherein the enclosure is an illuminated sign and the fixed relation within the enclosure is determined by a predetermined spatial relationship between the illumination device and a message printed on the illuminated sign.

15. The arrangement of claim 13, wherein said first and second fixation arrangements each comprise a stanchion having a plurality of couplers affixed thereto for engaging with a respective one of said first and second track ends.

16. The arrangement of claim 12, wherein said couplers are arranged to be accommodated longitudinally within a respective one of said first and second track ends.

17. The arrangement of claim 12, wherein there is further provided an adhesive for fixing said first and second fixation arrangements to the enclosure.

18. The arrangement of claim 12, wherein said mounting foot has a lamp mounting portion that is coupled about a collar of the illumination device.

19. The arrangement of claim 18, wherein said lamp mounting portion and said collar of the illumination device are configured to engage with one another whereby rotation of the illumination device with respect to said mounting foot is limited.

20. The arrangement of claim 12, wherein there are provided a plurality of illumination devices each having an associated one of a corresponding plurality of mounting feet, each for engaging slidably within the longitudinal engagement space of said longitudinal track.

21. The arrangement of claim 12, wherein said mounting foot is configured to prevent rotation of said mounting foot with respect to said longitudinal track.

22. The arrangement of claim 12, wherein there is further provided an adhesive for fixing said longitudinal track to the enclosure.

23. The arrangement of claim 12, wherein there is further provided electrical coupling means for coupling the illumination device to a source of electrical energy.

24. The arrangement of claim 23, wherein said electrical coupling means comprises means for converting a twin lead electrical interconnection arrangement into a screw shell electrical coupling arrangement.

25. A retrofit kit for an illuminated EXIT sign of the type having an original illumination device interposed between printed translucent panels, the original illumination device being removed to facilitate the retrofit kit, the retrofit kit comprising:

a replacement illumination device;

a longitudinal track having a defined longitudinal engagement space intermediate of first and second track ends;

a mounting foot coupled to the replacement illumination device for engaging slidably within the longitudinal engagement space of said longitudinal track; and a stanchion arrangement having a plurality of engagement portions extending transversely therefrom, each of said engagement portions being configured to engage with a track end for fixing said longitudinal track within the enclosure, the engagement portion engaged with the track end being selected in response to the location of the printed message on the printed translucent panels.

26. The retrofit kit of claim 25, wherein there is further provided an electrical converter for converting a twin lead into a screw shell electrical coupling arrangement.

27. The retrofit kit of claim 26, wherein said electrical converter is provided with a first pair of electrical terminals arranged as a lamp screw shell, and a second pair of electrical terminals, the second pair of electrical terminals being electrically coupled to the first pair of electrical terminals.

* * * * *

UNITED STATES PATENT AND TRADEMARK OFFICE

CERTIFICATE OF CORRECTION

PATENT NO. : 6,325,525 B1
DATED : December 4, 2001
INVENTOR(S) : Richard J. Camarota It is certified that error appears in the above-identified patent and that said Letters Patent is hereby corrected as shown below:

Column 3,
Line 58, after "longitudinal" insert -- engagement --.
Line 59, after "longitudinal" insert -- engagement --.
Line 62, delete "a variably adjustability" and insert therefor -- selectability --.

Column 4,
Line 25, after "longitudinal" insert -- engagement --.

Column 6,
Lines 22-25, cancel claim 13.
Lines 31-34, cancel claim 15.

Signed and Sealed this

Seventh Day of January, 2003

JAMES E. ROGAN
*Director of the United States Patent and Trademark Office*